US005084118A

United States Patent [19]

Poole

[11] Patent Number: 5,084,118

[45] Date of Patent: Jan. 28, 1992

[54] IGNITION COMPOSITION FOR INFLATOR GAS GENERATORS

[75] Inventor: Donald R. Poole, Woodinville, Wash.

[73] Assignee: Automotive Systems Laboratory, Inc., Farmington Hills, Mich.

[21] Appl. No.: 601,528

[22] Filed: Oct. 23, 1990

[51] Int. Cl.[5] ..... C06B 13/00

[52] U.S. Cl. ..... 149/22; 149/38; 149/42; 149/78; 149/88

[58] Field of Search ..... 149/22, 38, 42, 78, 149/88

[56] References Cited

U.S. PATENT DOCUMENTS

| | | | |
|---|---|---|---|
| 4,909,549 | 3/1990 | Poole et al. | 149/2 |
| 4,948,439 | 8/1990 | Poole et al. | 149/46 |
| 5,035,757 | 7/1991 | Poole | 149/46 |

*Primary Examiner*—Stephen J. Lechert, Jr.
*Attorney, Agent, or Firm*—Lyon & Delevie

[57] ABSTRACT

An autoigniting composition for the gas generator of a vehicle occupant restraint system that is thermally stable at temperatures up to 110° C., will not autoignite at 150° C., but when heated to approximately 177° C. will undergo rapid autoignition.

7 Claims, No Drawings

IGNITION COMPOSITION FOR INFLATOR GAS GENERATORS

BACKGROUND OF THE INVENTION

1. Field of the Invention

It is common practice to utilize a steel canister as the inflator pressure vessel of an automobile occupant restraint system because of the relatively high strength of steel at elevated temperatures. However, emphasis on vehicle weight reduction has renewed interest in the use of aluminum in place of steel in such pressure vessels.

One of the tests vehicle occupant restraint inflator systems must pass is exposure to fire whereupon the gas generating material of the inflator is expected to ignite and burn but the inflator pressure vessel must not rupture or throw fragments. With steel pressure vessels, this test was relatively easy to pass because steel retains most of its strength at ambient temperatures well above the temperature at which the gas generant autoignites. Aluminum, however, loses strength rapidly with increasing temperature and may not be able to withstand the combination of high ambient temperature and high internal temperature and pressure generated upon ignition of the gas generant. If, however, the gas generant of the inflator can be made to autoignite at relatively low temperatures, for example, 150° C. to 210° C., the inflator canisters can be made of aluminum.

2. Description of the Prior Art

One patent related to the subject matter of this invention is U.S. Pat. No. 4,561,675 granted to Adams et al. This patent discloses the use of Dupont 3031 single base smokeless powder as an autoignition gas generant. However, smokeless powder autoignites by a different mechanism than the compositions of the instant invention. Moreover, while such smokeless powder autoignites at approximately the desired temperature of 177° C., it is largely composed of nitrocellulose. It is well known in the propellant field that nitrocellulose is not stable for long periods at high ambient temperatures.

SUMMARY OF THE INVENTION

The invention relates to an ignition composition for an automobile occupant restraint system that will autoignite and cause ignition of the gas generant when heated to approximately 150° C. to 210° C. thereby permitting the use of an aluminum pressure vessel to contain the generant and gases produced by the generant.

DETAILED DESCRIPTION OF THE PREFERRED EMBODIMENT OF THE INVENTION

Basic requirements of an ignition composition for the gas generator used in an over-the-road vehicle occupant restraint system are that the ignition composition be; (1) thermally stable up to 110° C., (2) not autoignite below 150° C., and (3) autoignite rapidly at approximately 177° C. No single chemical compound is known that meets all of these requirements.

Although not completely understood, it is believed that the following factors contribute to the success of the mixture of ingredients comprising the compositions of the present invention.

A. The individual ingredients are separately stable up to the required temperature.

B. A "trigger" mechanism becomes effective at the required autoignition temperature changing the reaction rate from very low to very high over a small temperature range. This trigger is believed to be the melting of the combination of 5-aminotetrazole, hereinafter designated 5AT, and potassium or sodium chlorate which occurs at a temperature lower than the melting point of either ingredient separately. The melting apparently allows more intimate mixing and provides a more reactive medium.

C. The very active oxidizing character of an oxidizer selected from the group consisting of alkali metal or alkaline earth metal chlorates, preferably potassium or sodium chlorate is important. Other oxidizers such as potassium perchlorate and sodium or potassium nitrate provide the melting mentioned above but are not reactive enough to result in a quick autoignition.

D. The reactive nature of 2,4-dinitrophenyl-hydrazine, hereinafter termed DNPH is also believed to be important. It has also been found that certain chemical derivatives of DNPH, for example, the 2,4-dinitrophenylhydrazone of formaldehyde may be substituted for DNPH.

E. The reactivity of 5AT is believed to play a part in the autoignition but its exact role is unknown. One premise is that the 5AT provides a reactive medium which allows rapid reaction between the chlorate and DNPH.

A unique and highly desirable feature of the ignition compositions of the present invention are that they do not ignite when heated to 150° C., yet autoignite when heated to a temperature of only 27° C. to 60° C. higher. All of the following compositions are given in weight percent.

EXAMPLE 1

A mixture of sodium chlorate, 5-aminotetrazole (5AT) and DNPH was prepared having the following composition: 60% $NaClO_3$, 20% 5AT and 20% DNPH.

Sodium chlorate and 5AT, which had previously been ball milled (separately) to reduce their particle size, were weighed and mixed with the weighed DNPH by dry-blending. A sample of this powder was tested in a differential scanning calorimeter (DSC) and a small endotherm was observed at 174° C. followed closely by a large exothermic reaction at approximately 177° C.

Pellets of this material were compression molded and then crushed and sieved to provide hard granules in the 24 to 60 mesh range. These granules were subsequently used in an inflator which was successfully tested in a bonfire test.

EXAMPLE 2

A mixture of 66.0% sodium chlorate, 22.7% 5AT and 11.3% DNPH was prepared as described in Example 1. When the mixed powder was tested on a DSC the results were essentially identical to those of Example 1.

EXAMPLE 3

A mixture of 40.0% sodium chlorate, 40.0% 5AT and 20.0% DNPH was prepared as described in Example 1. When the mixed powder was tested on a DSC the results were essentially the same as for Example 1 except that the endotherm was somewhat larger and the exotherm was somewhat smaller.

EXAMPLE 4

A mixture of 67.0% sodium chlorate, 16.5% 5AT and 16.5% DNPH was prepared as described in Example 1.

When the mixed powder was tested on a DSC a very small endotherm was observed at 174° C. followed closely by an exotherm at approximately 176° C.

EXAMPLE 5

A mixture of potassium chlorate, 5AT and DNPH was prepared having the following composition: 60.0% potassium chlorate, 20.0% 5AT and 20.0% DNPH.

A mixture of equal weights of 5AT and DNPH was ball-milled to mix and reduce the particle size of the materials. A portion of this mixture was combined with the weighed potassium chlorate which had been ball-milled separately. The mixture was dry blended and a sample of the powder was tested on a DSC with results essentially identical to those of Example 1. This example demonstrates that potassium chlorate may be substituted for sodium chlorate.

EXAMPLE 6

A mixture of 60.0% potassium chlorate, 20.0% 5AT and 20.0% DNPH was prepared by the technique described in Example 5. To this mixture was added a small amount of methylene chloride sufficient to form a damp powder. To this powder was added a solution of polycarbonate resin dissolved in methylene chloride in an amount sufficient to provide a final composition containing 4% polycarbonate. After mixing thoroughly and removing the methylene chloride, the resulting powder or granular material can be used directly or can be compression molded into pellets of various sizes and shapes.

When this material was tested on a DSC, a small exotherm was observed at approximately 162° C. followed by a large exothermic reaction at 177° C.

EXAMPLE 7

A mixture of 60.0% potassium chlorate, 20.0% 5AT and 20.0% DNPH was prepared by the technique described in Example 5. To this mixture was added a solution of thermoplastic rubber dissolved in toluene in an amount sufficient to provide a final composition containing 4.0% thermoplastic rubber. After mixing thoroughly, this material was forced through a metal mesh forming small granules which were then dried at 80° C. to remove the toluene solvent. The resulting granules, when tested on a DSC, showed a small exotherm at approximately 164° C. followed by a large exothermic reaction at 176° C. This material after being heated in an oven for 400 hours at 107° C. when tested on a DSC was found to be essentially unchanged. This material may also be extruded through a small orifice forming a solid string which can be cut into small cylinders of an appropriate length.

EXAMPLE 8

A mixture of 65.0% potassium chlorate, 16.5% 5AT, 16.5% DNPH and 2% of a metal powder selected from the group consisting of titanium, zirconium, boron and aluminum was prepared as described in Example 5. When a sample of this mixture was tested on the DSC a small endotherm was observed at approximately 171° C. followed by a large exothermic reaction at 179° C.

EXAMPLE 9

A mixture of 60% potassium chlorate, 20% 5AT and 20% of the formaldehyde hydrazone derivative of DNPH was prepared by dry blending the ingredients by the procedure described in Example 1. When a sample was tested on the DSC an endotherm was observed at 156° C. followed by a large exothermic reaction at approximately 168° C.

While the preferred embodiment of the invention has been disclosed, it should be appreciated that the invention is susceptible of modification without departing from the scope of the following claims.

I claim:

1. An autoigniting composition for the gas generator of a vehicle occupant restraint system comprising a mixture of from about 40% to 67% by weight of sodium chlorate, from about 16.5% to 40% by weight of 5-aminotetrazole, and from about 11.3% to 20% by weight of 2,4-dinitrophenylhydrazone.

2. An autoigniting composition for the gas generator of a vehicle occupant restraint system comprising a mixture of about 60% by weight of potassium chlorate, about 20% by weight of 5-aminotetrazole, and about 20% by weight of 2,4-dinitrophenylhydrazone.

3. The composition of claim 2 including 4% to 10% by weight of a polycarbonate resin dissolved in methylene chloride.

4. The composition of claim 2 including 4% to 10% by weight of thermoplastic rubber dissolved in toluene.

5. An autoigniting composition for the gas generator of a vehicle occupant restraint system comprising a mixture of about 65% by weight of potassium chlorate, about 16.5% by weight of 5-aminotetrazole, about 16.5% by weight of 2,4-dinitrophenylhydrazone, and about 2% to 4% by weight of a metal powder selected from the group consisting of titanium, zirconium, boron and aluminum.

6. An autoignition composition for the gas generator of a vehicle occupant restraint system comprising a mixture of from about 16% to 40% by weight 5-aminotetrazole, from about 11% to 40% by weight, 2,4-dinitrophenylhydrazone, and from about 40% to 67% by weight of an oxidizer selected from the group consisting of alkali metal or alkaline earth metal chlorates.

7. An autoignition composition for the gas generator of a vehicle occupant restraint system comprising a mixture of from about 16% to 40% by weight 5-aminotetrazole, from about 11% to 40% by weight of an active material selected from the group consisting of the aldehyde or ketone hydrazone derivatives of 2,4-dinitrophenylhydrazone and from about 40% to 67% by weight of an oxidizer selected from the group consisting of alkali metal or alkaline earth metal chlorates.

* * * * *